US009377710B1

(12) United States Patent
Tomari et al.

(10) Patent No.: US 9,377,710 B1
(45) Date of Patent: Jun. 28, 2016

(54) CONDUCTIVE MEMBER, PROCESS CARTRIDGE, AND IMAGE FORMING APPARATUS

(71) Applicant: FUJI XEROX CO., LTD., Tokyo (JP)

(72) Inventors: Shogo Tomari, Kanagawa (JP); Hiroyuki Miura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/791,750

(22) Filed: Jul. 6, 2015

(30) Foreign Application Priority Data

Feb. 5, 2015 (JP) ..... 2015-021155

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS

2011/0052262 A1* 3/2011 Tomari ..... B32B 25/04 399/176

FOREIGN PATENT DOCUMENTS

JP 2011-107547 A 6/2011

* cited by examiner

*Primary Examiner* — Joseph S Wong
(74) *Attorney, Agent, or Firm* — Oliff PLC

(57) ABSTRACT

A conductive member includes: a conductive support; a conductive elastic layer that is provided on the conductive support and includes a vulcanizate of an unvulcanized rubber material; and a surface layer that is provided on the conductive elastic layer and includes a cured product of an oxygen-curable unsaturated compound.

11 Claims, 6 Drawing Sheets

CONDUCTIVE MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-021155 filed Feb. 5, 2015.

BACKGROUND

1. Technical Field

The present invention relates to a conductive member, a process cartridge, and an image forming apparatus.

2. Related Art

In the image forming apparatus using an electrophotographic system, first, charge is formed on the surface of an image holding member such as a photoconductive photoreceptor including an inorganic or organic material using a charging device, and after forming an electrostatic latent image by a laser beam or the like obtained by modulating an image signal, by developing the electrostatic latent image with the charged toner, a visualized toner image is formed. Furthermore, the toner image is electrostatically transferred to a recording medium such as a recording sheet through an intermediate transfer member or directly, and a reproduced image is obtained by fixing the image to the recording medium.

Here, as the charging device for charging the surface of an image holding member, a conductive member is suitably used.

SUMMARY

According to an aspect of the invention, there is provided a conductive member including:

a conductive support;

a conductive elastic layer that is provided on the conductive support and includes a vulcanizate of an unvulcanized rubber material; and a surface layer that is provided on the conductive elastic layer and includes a cured product of an oxygen-curable unsaturated compound.

BRIEF DESCRIPTION OF THE DRAWINGS

Exemplary embodiments of the present invention will be described in detail based on the following figures, wherein.

DETAILED DESCRIPTION

Figure 1:
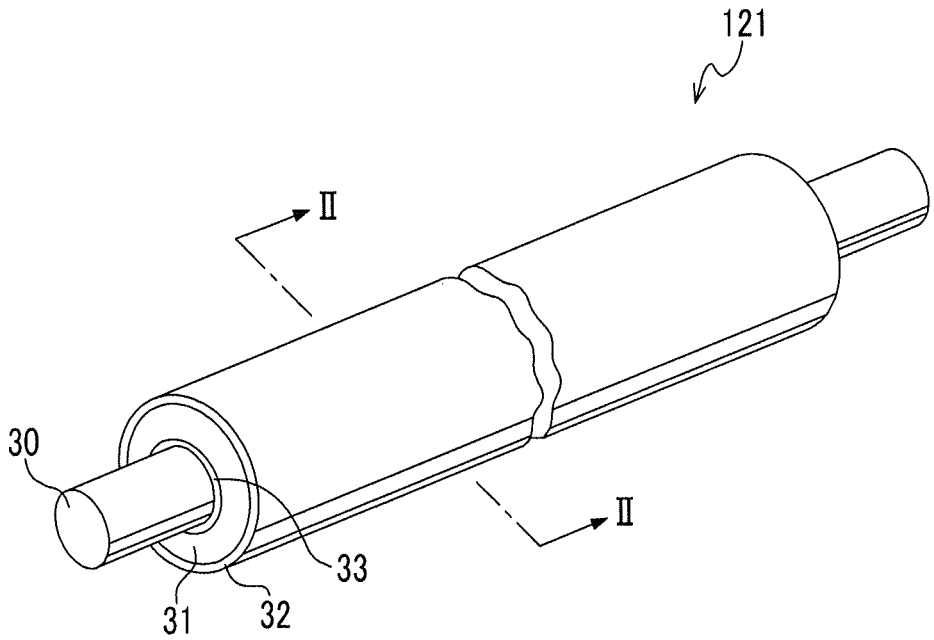
FIG. 1 is a schematic perspective view showing an example of a configuration of a conductive member according to the exemplary embodiment.

Hereinafter, the exemplary embodiment which is an example of the invention will be described in detail.

Conductive Member

The conductive member according to the exemplary embodiment has a conductive support (hereinafter, also referred to as "support"), a conductive elastic layer provided on the conductive support (hereinafter, also referred to as "elastic layer"), and a surface layer provided on the conductive elastic layer. Furthermore, the elastic layer includes a vulcanizate of an unvulcanized rubber material. On the other hand, the surface layer includes a cured product of an oxygen-curable unsaturated compound (hereinafter, also referred to as "oxygen-curable compound").

Moreover, the conductivity in the specification means that the volume resistivity at 20° C. is less than $1\times10^{14}$ Ωcm.

In the conductive member according to the exemplary embodiment, peeling of the surface layer is prevented by the above configuration. This is because it is considered that the oxygen-curable unsaturated compound has a low shrinkage ratio when cured, and has high adhesiveness with the lower layer (for example, elastic layer) of the surface layer compared to the ultraviolet ray-curable acrylic monomer.

In particular, in the conductive member according to the exemplary embodiment, the elastic layer and the surface layer are preferably formed through at least a step of forming a layer of a rubber composition including the unvulcanized rubber material and the oxygen-curable compound on a support, a step of depositing the oxygen-curable compound on the surface of the layer of the rubber composition, and a step of performing vulcanizing of the unvulcanized rubber material and curing of the oxygen-curable compound in a state in which the oxygen-curable compound is deposited on the surface of the layer of the rubber composition.

That is, a deposition layer obtained by depositing an oxygen-curable compound is formed on the surface of the layer of the rubber composition including the unvulcanized rubber material and the oxygen-curable unsaturated compound. In a state in which the deposition layer is formed on the surface of the layer of the rubber composition, vulcanizing of the unvulcanized rubber material and curing of the oxygen-curable compound are performed. Then, an elastic layer including a vulcanizate of the unvulcanized rubber material is formed, and a surface layer including a cured product of the oxygen-curable compound is directly formed on the elastic layer.

By being deposited on the surface of the layer of the rubber composition, the oxygen-curable compound is likely to form a deposition layer in a state in which the thickness is nearly uniform. When curing the oxygen-curable compound of the deposition layer, a surface layer of which the thickness is nearly uniform and the surface quality is high is likely to be formed. Therefore, a nearly uniform contact width (nip width) between the surface layer of the conductive member and a member to be charged is likely to be ensured. Accordingly, when forming an elastic layer and a surface layer through at least the above steps, charge unevenness is likely to be prevented. In addition, separately, a coating step for forming a surface layer may be omitted, and cost reduction may also be achieved.

Here, although the conductive member according to the exemplary embodiment may have a form configured of only a support, an elastic layer, and a surface layer, for example, the conductive member according to the exemplary embodiment may have a configuration provided with an intermediate layer (adhesive layer) provided between the elastic layer and the support and an intermediate layer (for example, a resistance controlling layer and a migration preventing layer) provided between the elastic layer and the surface layer.

Hereinafter, the conductive member according to the exemplary embodiment will be described in detail with reference to drawings.

Figure 2:
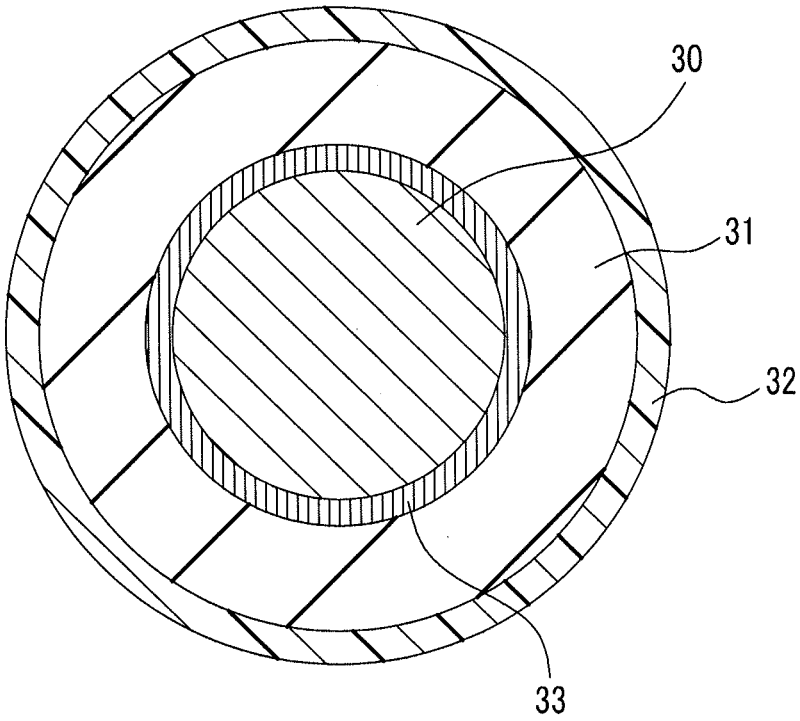
FIG. 2 is a schematic cross-sectional view showing an example of a configuration of the conductive member according to the exemplary embodiment.

FIG. 1 is a schematic perspective view showing an example of the conductive member according to the exemplary embodiment. FIG. 2 is a schematic cross-sectional view which is cut along a line II-II of the conductive member shown in FIG. 1.

As shown in FIGS. 1 and 2, a conductive member 121 according to the exemplary embodiment is, for example, a roll member (charging roll) having a support 30 (shaft), an adhesive layer 33 provided on the outer peripheral surface of the support 30, an elastic layer 31 provided on the outer peripheral surface of the adhesive layer 33, and a surface layer 32 provided on the outer peripheral surface of the elastic layer 31.

Hereinafter, the configuration elements of the conductive member according to the exemplary embodiment will be described in detail. Moreover, hereinafter, the reference numbers will not be written in the description.

Support

The support is a member (shaft) functioning as an electrode and a support member of the conductive member. Examples of the material of the support include metals such as iron (free-cutting steel or the like), copper, brass, stainless steel, aluminum, and nickel. As the support, a member (for example, a resin member and a ceramic member) subjected to a plating treatment on the outer surface, a member (for example, a resin member and a ceramic member) in which a conductive material is dispersed, and the like may also be exemplified.

The support may be a hollow shape member (cylindrical member), or may be a non-hollow shape member (columnar member).

Elastic Layer

The elastic layer is a layer including a vulcanizate of the unvulcanized rubber material. The elastic layer may be a layer including an additive such as a conductive material other than the vulcanizate of the unvulcanized rubber material.

The unvulcanized rubber is a material also including an elastomer. Examples of the unvulcanized rubber include an unvulcanized rubber which has at least a carbon-carbon double bond in the chemical structure and becomes a rubber by crosslinking by a vulcanization reaction.

Examples of the unvulcanized rubber material include well-known unvulcanized rubber materials such as isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylonitrile-butadiene copolymer rubber (NBR), natural rubber, and rubbers obtained by mixing these.

These unvulcanized rubber materials may be used alone or in combination of two or more kinds thereof.

The unvulcanized rubber material preferably includes an unvulcanized rubber material having a polar group. Here, examples of the polar group include an urethane group (—NHC(=O)O—), an ether group (—O—), a cyano group (—CN), a hydroxyl group (—OH), a halogen group (for example, —Cl or —Br). The rubber material having a polar group has at least one of these polar groups in a molecule.

When including the unvulcanized rubber material having a polar group as the unvulcanized rubber material, a surface layer of which the film thickness is nearly uniform and the surface quality is high is likely to be formed by the interaction with the oxygen-curable compound. Therefore, charge unevenness is likely to be prevented.

In particular, in the case of forming an elastic layer and a surface layer by depositing the oxygen-curable compound on the surface of the layer of the rubber composition including the unvulcanized rubber material and the oxygen-curable compound, when including the unvulcanized rubber material having a polar group as the unvulcanized rubber, the oxygen-curable compound is likely to be deposited on the surface of the layer of the rubber composition by the interaction between the unvulcanized rubber material having a polar group and the oxygen-curable compound. Therefore, furthermore, a surface layer of which the film thickness is nearly uniform and the surface quality is high is likely to be formed. Accordingly, furthermore, charge unevenness is likely to be prevented.

Specific examples of the unvulcanized rubber material having a polar group include polyurethane, epichlorohydrin-ethylene oxide copolymer rubber, epichlorohydrin-ethylene oxide-allyl glycidyl ether copolymer rubber, NBR, and rubber materials obtained by mixing these.

The content of the unvulcanized rubber material (vulcanizate thereof) having a polar group is preferably from 30 parts by weight to 80 parts by weight, and more preferably from 40 parts by weight to 70 parts by weight with respect to 100 parts by weight of the entirety of the unvulcanized rubber material (vulcanizate thereof) from the viewpoint of preventing charge unevenness.

The unvulcanized rubber material preferably includes the unvulcanized liquid rubber material. The liquid rubber material means a rubber material which is liquid at ordinary temperature (25° C.), and is semi-liquid (semi-solid) having a melting point from 60° C. to 120° C.

When including the unvulcanized liquid rubber material as the unvulcanized rubber material, flexibility is likely to be imparted to the elastic layer. Therefore, a nearly uniform contact width (nip width) between the surface layer of the conductive member and a member to be charged is likely to be ensured. Accordingly, charge unevenness is likely to be prevented.

In particular, in the case of forming an elastic layer and a surface layer by depositing the oxygen-curable compound on the surface of the layer of the rubber composition including the unvulcanized rubber material and the oxygen-curable compound, when including the unvulcanized liquid rubber material as the unvulcanized rubber, in particular, the unvulcanized liquid rubber material is reacted with the oxygen-curable compound, and due to this, flexibility is likely to be imparted to the periphery of the interface between the elastic layer and the surface layer and to the elastic layer. Therefore, furthermore, a nearly uniform contact width (nip width) between the surface layer of the conductive member and a member to be charged is likely to be ensured. Accordingly, further, charge unevenness is likely to be prevented.

Specific examples of the unvulcanized liquid rubber material include liquid acrylonitrile butadiene copolymer rubber, liquid chloroprene rubber, liquid isoprene rubber, liquid polybutadiene rubber, and rubber materials obtained by mixing these.

The content of the unvulcanized liquid rubber material (vulcanizate thereof) is preferably from 1 part by weight to 15 parts by weight, and more preferably from 3 parts by weight to 10 parts by weight with respect to 100 parts by weight of the entirety of the unvulcanized rubber material (vulcanizate thereof) from the viewpoint of preventing charge unevenness.

The vulcanizates of these unvulcanized rubber materials may be foamed members, or may be non-foamed members. That is, the elastic layer may be a foamed elastic layer, or may be a non-foamed elastic layer.

The content of the vulcanizate of the entirety of the unvulcanized rubber is preferably from 1% by weight to 10% by weight, and more preferably from 2% by weight to 8% by weight with respect to the total weight of the elastic layer.

Examples of the conductive material include an electron conductive material and an ion conductive material.

Examples of the electron conductive material include powders such as carbon blacks such as Ketjen black and acetylene black; pyrolytic carbon and graphite; various conductive metals or alloys such as aluminum, copper, nickel, and stainless steel; various conductive metal oxides such as tin oxide, indium oxide, titanium oxide, a tin oxide-antimony oxide solid solution, and a tin oxide-indium oxide solid solution; and materials obtained by performing a conduction treatment on the surface of an insulating material.

Examples of the ion conductive material include perchlorates or chlorates of, for example, tetraethyl ammonium and lauryl trimethyl ammonium; and perchlorates or chlorates of alkali metals or alkaline earth metals such as lithium and magnesium.

These conductive materials may be used alone or in combination of two or more kinds thereof.

Here, specific examples of the carbon black include "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V" manufactured by Degussa, and "MONARCH 1000", "MONARCH 1300", "MONARCH 1400", "MOGUL-L", and "REGAL 400R" manufactured by Cabot Corporation.

The average particle diameter of the conductive material is preferably from 1 nm to 200 nm.

Moreover, the average particle diameter is calculated by observing a sample obtained by cutting out an elastic layer using an electron microscope, by measuring diameters (maximum diameters) of 100 particles of the conductive material, and by averaging the diameters.

Although the amount of the conductive material added is not particularly limited, in the case of the above-described electron conductive material, the amount of the electron conductive material added is preferably in the range from 1 part by weight to 30 parts by weight, and more preferably in the range from 15 parts by weight to 25 parts by weight, with respect to 100 parts by weight of the unvulcanized rubber material (vulcanizate thereof). On the other hand, in the case of the above-described ion conductive material, the amount of the ion conductive material added is preferably in the range from 0.1 parts by weight to 5.0 parts by weight, and more preferably in the range from 0.5 parts by weight to 3.0 parts by weight, with respect to 100 parts by weight of the unvulcanized rubber material (vulcanizate thereof).

Examples of additives other than the conductive materials include well-known additives such as a softener, a plasticizer, a vulcanizer, a vulcanization accelerator, an antioxidant, a surfactant, and a coupling agent.

In a case where the elastic layer also serves as a resistance controlling layer, for example, the volume resistivity of the elastic layer may be $10^3$ Ωcm or greater and less than $10^{14}$ Ωcm, is preferably from $10^5$ Ωcm to $10^{12}$ Ωcm, and more preferably from $10^7$ Ωcm to $10^{12}$ Ωcm.

The volume resistivity of the elastic layer is a value measured by the following method.

That is, a sheetshaped sample for measurement is collected from the elastic layer, then, a voltage which is adjusted so as to become an electric field (applied voltage/composition sheet thickness) of 1000 V/cm is applied to the measurement sample for 30 seconds using a measuring tool (R12702A/B resistivity-chamber: manufactured by Advantest Corporation Ltd.) and a high resistance measuring instrument (R8340A digital high resistance/microammeter: manufactured by Advantest Corporation Ltd.) according to JIS K 6911 (1995), and then the volume resistivity is calculated using the flowing current value by the following equation.

Volume resistivity (Ωcm)=(19.63×applied voltage (V))/(current value (*A*)×measurement sample thickness (cm))

The surface roughness Rz of the elastic layer may preferably be, for example, 20 μm or less from the viewpoint of preventing the toner or dust from being accumulated at the recessed portion of the surface layer.

The surface roughness Rz of the elastic layer is a value measured by the following method. Measurements are performed at three points of two positions which are 20 mm apart from respective ends in the axial direction of the elastic layer and the center portion according to JIS B 0601 (1994), and the obtained values are averaged. As the measurement device, SURFCOM 1400 manufactured by Tokyo Seimitsu Co., Ltd. is used. As the measurement conditions, the cutoff is set to 0.8 mm, the measurement length is set to 2.4 mm, and the traverse speed is set to 0.3 mm/sec.

Although the thickness of the elastic layer varies depending on the device to which the conductive member is applied, for example, the thickness of the elastic layer may be 1 mm to 10 mm, and is preferably 2 mm to 5 mm.

The thickness of the elastic layer is a value measured by the following method.

That is, the three points of two positions which are 20 mm apart from respective ends in the axial direction of the elastic layer and the center portion are cut out with a single-edged knife, the cross section of the sample cut off is observed at a suitable magnification from 5 times to 50 times according to the thickness, the thickness is measured, and the obtained values are averaged. As the measurement device, a digital microscope VHX-200 manufactured by Keyence Corporation is used.

Adhesive Layer

The adhesive layer is formed of, for example, a composition including an adhesive (resin or rubber).

The adhesive layer may be formed of, as necessary, a composition including an additive such as a conductive material other than the adhesive layer.

Examples of the resin include a polyurethane resin, an acrylic resin (for example, a polymethyl methacrylate resin or a polybutyl methacrylate resin), a polyvinyl butyral resin, a polyvinyl acetal resin, a polyarylate resin, a polycarbonate resin, a polyester resin, a phenoxy resin, a polyvinyl acetate resin, a polyamide resin, a polyvinyl pyridine resin, and a cellulose resin.

Examples of the resin include a butadiene resin (RB), a polystyrene resin (for example, a styrene-butadiene-styrene elastomer (SBS)), a polyolefin resin, a polyester resin, a polyurethane resin, a polyethylene resin (PE), a polypropylene resin (PP), a polyvinyl chloride resin (PVC), an acrylic resin, a styrene-vinyl acetate copolymer resin, a butadiene-acrylonitrile copolymer resin, an ethylene-vinyl acetate copolymer resin, an ethylene-ethyl acrylate copolymer resin, an ethylene-methacrylic acid (EMAA) copolymer resin, and resins obtained by denaturing these resins.

Examples of the rubber include rubbers such as ethylene-propylene-diene terpolymer rubber (EPDM), polybutadiene, natural rubber, polyisoprene, styrene butadiene rubber (SBR), chloroprene rubber (CR), nitrile butadiene rubber (NBR), silicone rubber, urethane rubber, and epichlorohydrin rubber.

Among these, preferable examples of the resin or the rubber include chloroprene, epichlorohydrin, chlorosulfonated polyethylene, and chlorinated polyethylene.

Examples of the conductive material include conductive powders such as carbon blacks such as Ketjen black and acetylene black; pyrolytic carbon and graphite; various conductive metals or alloys such as aluminum, copper, nickel, and stainless steel; various conductive metal oxides such as tin oxide, indium oxide, titanium oxide, a tin oxide-antimony oxide solid solution, and a tin oxide-indium oxide solid solution; and materials obtained by performing a conduction treatment on the surface of an insulating material.

The average particle diameter of the conductive material is preferably from 0.01 μm to 5 μm, more preferably from 0.01 μm to 3 μm, and still more preferably from 0.01 μm to 2 μm.

Moreover, the average particle diameter is calculated by observing a sample obtained by cutting out an adhesive layer using an electron microscope, by measuring 100 diameters (maximum diameters) of 100 particles of the conductive material, and by averaging the diameters.

The content of the conductive material is preferably from 0.1 parts by weight to 6 parts by weight, more preferably from 0.5 parts by weight to 6 parts by weight, still more preferably from 1 part by weight to 3 parts by weight with respect to 100 parts by weight of the total weight of the adhesive layer.

As the additive other than the conductive material, a crosslinking agent, a curing accelerator, an inorganic filler, an organic filler, a flame retardant, an antistatic agent, a conductive imparting agent, a lubricant, a sliding property-imparting agent, a surfactant, a colorant, or an acid acceptor may be contained. Two or more types of these may be contained.

Surface Layer

The surface layer is a layer including a cured product of the oxygen-curable compound. The surface layer may be a layer including an additive other than the cured product of the oxygen-curable compound.

The oxygen-curable compound is a compound having unsaturated bonds (carbon-carbon double bonds) and oxygen-curable properties. That is, the oxygen-curable compound is a compound which is cured by a reaction (oxidation curing reaction) between unsaturated bonds (carbon-carbon double bond) by oxygen.

Examples of the oxygen-curable compound include an unsaturated fatty acid. Furthermore, examples of the unsaturated fatty acid include drying oil. Examples of the drying oil include tung oil, linseed oil, cotton seed oil, soybean oil, rice bran oil, dehydrated castor oil, and tall oil.

Examples of the oxygen-curable compound include various alkyd resins obtained by modifying unsaturated fatty acids (for example, drying oil) (for example, alkyd resins obtained by modifying linseed oil or tung oil with a phenolic resin), a reaction product of drying oil with a functional polyoxyalkylene and a reaction product of an unsaturated fatty acid (for example, drying oil) with an isocyanate compound (urethanated oil), and also various resins modified by unsaturated fatty acids (for example, drying oil) (for example, an acrylic resin, a phenolic resin, an epoxy, resin, and a silicone resin).

Among these, as the oxygen-curable compound, tung oil or linseed oil is preferable from the viewpoint of preventing peeling of the surface layer and charge unevenness.

The oxygen-curable compound may be used alone or in combination of two or more kinds thereof.

The iodine value of the oxygen-curable compound is preferably from 130 to 220 cg/g (i.e., from 130 g/100 g to 220 g/100 g), more preferably from 130 to 190 cg/g (i.e., from 130 g/100 g to 190 g/100 g), and still more preferably from 140 to 180 cg/g (i.e., from 140 g/100 g to 180 g/100 g) from the viewpoint of preventing peeling of the surface layer.

The iodine value of the oxygen-curable compound is a value measured by the following method.

Measurement is performed according to JIS K0070-1992 "Test methods for acid value, saponification value, ester value, iodine value, hydroxyl value and unsaponifiable matter of chemical products", the iodine value of the oxygen-curable compound is calculated from the following equation.

$$\text{Iodine value (cg/g)}=(BL1-EP1)\times TF\times C1\times K1/SIZE$$

$EP1$: Titration amount (mL)

BL1: Blank value (47.074 mL)

TF: Factor of titrant (1.006)

C1: Concentration conversion coefficient (1.269)

(atomic weight of iodine of 126.9/100)

K1: Unit conversion coefficient (1)

SIZE: Amount of a sample (g)

The content of the cured product of the oxygen-curable compound is preferably from 95.0% by weight to 97.0% by weight, and more preferably from 97.0% by weight to 99.0% by weight with respect to the total weight of the surface layer.

The oxygen-curable compound is preferably used in combination with a curing accelerator. When using in combination with a curing accelerator, the curing reaction of the oxygen-curable compound is likely to be accelerated. Examples of the curing accelerator include a metal salt (for example, a salt of cobalt, lead, or zirconium) of a fatty acid (for example, naphthenic acid or octylic acid) having 6 to 21 carbon atoms and an azo compound. The curing accelerator may be used alone or in combination of two or more kinds thereof.

Examples of the metal salt of a fatty acid include cobalt naphthenate, lead naphthenate, zirconium naphthenate, cobalt octylate, zinc octylate, and zirconium octylate. The amount of the metal salt of a fatty acid is preferably from 1 part by weight to 10 parts by weight, and more preferably from 2 parts by weight to 5 parts by weight with respect to 100 parts by weight of the oxygen-curable compound.

Examples of the azo compound include dimethyl azobis (isobutyrate) and azobisisobutyronitrile (AIBN).

The content of the azo compound is preferably from 0.01 parts by weight to 1.0 part by weight, and more preferably from 0.05 parts by weight to 0.5 parts by weight with respect to 100 parts by weight of the oxygen-curable compound.

Examples of other additives include well-known compounds such as a plasticizer, a softener, a vulcanization accelerator, and a vulcanizer.

The surface layer may preferably have insulating properties.

Specifically, the volume resistivity of the surface layer is, for example, $10^{14}$ Ωcm or greater.

The volume resistivity of the surface layer is a value measured by the same method as that in the measurement of the volume resistivity of the elastic layer.

The thickness of the surface layer is, for example, preferably from 0.01 μm to 1000 μm, more preferably from 0.1 μm to 500 μm, and still more preferably from 0.5 μm to 100 μm.

The thickness of the surface layer is a value measured by the same method as that in the measurement of the thickness of the elastic layer.

Preparation Method of Conductive Member

Hereinafter, an example of the conductive member according to the exemplary embodiment will be described.

The preparation method of a conductive member according to the exemplary embodiment has, for example, a step of forming a layer of a rubber composition including an unvulcanized rubber material and an oxygen-curable compound on a support (hereinafter, also referred to as "first step"), a step of depositing the oxygen-curable compound on the surface of the layer of the rubber composition (hereinafter, also referred to as "second step"), and a step of forming an elastic layer including a vulcanizate of the unvulcanized rubber material on the support and of forming a surface layer including a cured product of the oxygen-curable compound by performing vulcanizing of the unvulcanized rubber material and curing the oxygen-curable unsaturated compound in a state in which the oxygen-curable compound is deposited on the surface of the layer of the rubber composition (hereinafter, also referred to as "third step").

Hereinafter, each step will be described in detail.

First Step

In the first step, a layer of a rubber composition (hereinafter, also referred to as "rubber material") including an unvulcanized rubber material and an oxygen-curable compound is formed on a support (hereinafter, also referred to as "core metal"). Specifically, for example, using an extruder 210 shown in FIG. 3, a cylindrical rubber material layer (hereinafter, also referred to as "rubber roll portion") is formed on, the outer peripheral surface of the core metal.

Here, the rubber material (rubber composition) is obtained by kneading the unvulcanized rubber material and the oxygen-curable compound using a kneader. In addition, the rubber material (rubber composition) is obtained by kneading, if necessary, other additives.

From the viewpoint of ensuring the thickness of the deposition layer which becomes the surface layer by sufficiently depositing the oxygen-curable compound, the content of the oxygen-curable compound in the rubber material (rubber composition) before forming may be from 1 part by weight to 15 parts by weight (preferably 3 parts by weight to 10 parts by weight) with respect to 100 parts by weight of the unvulcanized rubber material. In addition, in the case of using in combination with a curing accelerator, the content of the curing accelerator may be from 1 part by weight to 10 parts by weight (preferably from 2 parts by weight to 5 parts by weight), as a metal salt of a fatty acid, and may be from 0.01 parts by weight to 1.0 part by weight (preferably from 0.05 parts by weight to 0.5 parts by weight), as an azo compound, with respect to 100 parts by weight of the oxygen-curable compound.

The content of the unvulcanized rubber material may be from 30% by weight to 80% by weight (preferably from 40% by weight to 70% by weight) with respect to the total weight of the rubber material (rubber composition).

Extruder

Figure 3:
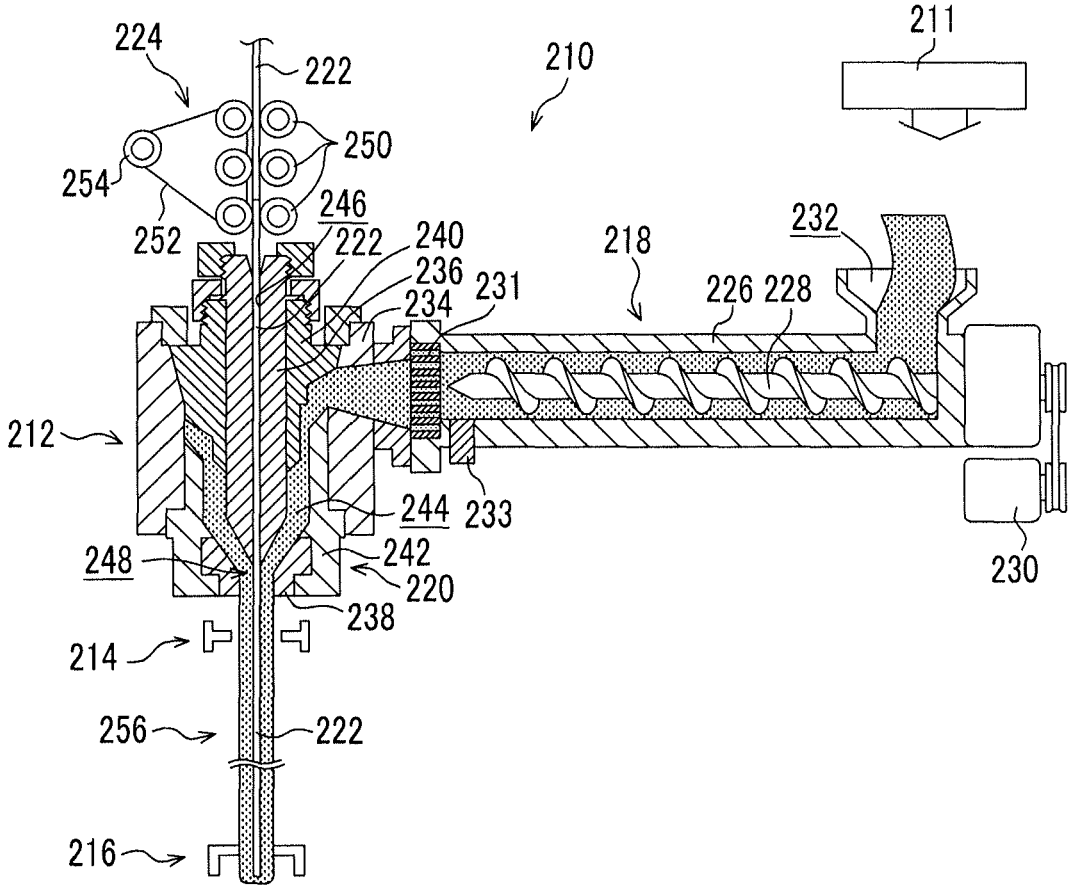
FIG. 3 is a schematic diagram showing an example of a configuration of an extruder provided with a crosshead.

Extruder 210 shown in FIG. 3 is provided with a discharger 212 configured of a so-called crosshead die, a pressurizer 214 provided on the downstream side of the discharger 212, and a drawing machine 216 provided on the downstream side of the pressurizer 214.

Furthermore, the extruder 210 is provided with a controller 211 for controlling each part of the device.

The discharger 212 is provided with a rubber material supply portion 218 for supplying the rubber material, an extruding portion 220 for extruding the rubber material supplied from the rubber material supply portion 218 into a cylindrical shape, and a core metal supply portion 224 for supplying a core metal 222 to the center portion of the rubber material extruded from the extruding portion 220 into a cylindrical shape.

The rubber material supply portion 218 has a screw 228 in a cylindrical main member portion 226. The screw 228 is rotationally driven by a drive motor 230. On the drive motor 230 side of the main member portion 226, an input port 232 for inputting the rubber material is provided. In the rubber material extruding port of the cylindrical main member portion 226, a breaker plate 231 is provided. The rubber material input from the input port 232 is sent toward the extruding portion 220 through the breaker plate 231 while being kneaded by the screw 228 in the main member portion 226.

The extruding portion 220 is provided with a cylindrical case 234 connected to the rubber material supply portion 218, a cylindrical mandrel 236 provided at the inner center of the case 234, and a discharge head 238 provided below the mandrel 236. The mandrel 236 is held by the case 234 through a holding member 240. The discharge head 238 is held by the case 234 through a holding member 242. An annular channel 244 in which rubber material flows in an annular shape is formed between the outer peripheral surface of the mandrel 236 (outer peripheral surface of the holding member 240 in part) and the inner peripheral surface of the holding member 242 (inner peripheral surface of the discharge head 238 in part).

At the center portion of the mandrel 236, an inserting hole 246 for inserting the metal core 222 is formed. The lower portion of the mandrel 236 has a shape which is tapered towards the end. Furthermore, the region below the tip of the mandrel 236 becomes a joining region 248 where the core metal 222 supplied from the inserting hole 246 and the rubber material supplied from the annular channel 244 are joined. That is, the rubber material is extruded toward the joining region 248 into a cylindrical shape, and the core metal 222 is transported to the center portion of the rubber material extruded into a cylindrical shape.

The core metal supply portion 224 is provided with roll pairs 250 provided above the mandrel 236. As the roll pairs 250, a plurality of pairs (three pairs) are provided, one roll of each roll pair 250 is connected to a drive roll 254 through a belt 252. When the drive roll 254 is driven, the core metal 222 nipped by each roll pair 250 is sent toward the inserting hole 246 of the mandrel 236. The core metal 222 has a predetermined length, and a plurality of the core metals 222 are sequentially passed through the inserting hole 246 by pressing of the core metal 222 of the front side which is present at the inserting hole 246 of the mandrel 236 by the core metal 222 of the back side which is sent by the roll pair 250. In addition, when the forward end of the metal core 222 of the front side is positioned at the front end of the mandrel 236, drive of the drive roll 254 is temporarily stopped, and the core metal 222 is transported at intervals to the joining region 248 below the mandrel 236.

In this manner, in the extruder 212, the rubber material is extruded into a cylindrical shape at the joining region 248, and the core metals 222 are sequentially transported at intervals to the center portion of the rubber material. As a result, the outer peripheral surface of the core metal 222 is coated with the rubber material, and the rubber roll portion 256 (cylindrical rubber material layer) is formed on the outer peripheral surface of the core metal 222. Moreover, an adhesive layer (that is, primer or adhesive) may be applied in advance in order to improve the adhesive properties to the rubber material on the outer peripheral surface of the core metal 222.

Moreover, the controller 211 is configured so as to control the operation of each portion of the extruder 210.

Specifically, although the controller 211 is not shown in the drawing, for example, the controller 211 is configured as a computer, and has a configuration in which each of a Central Processing Unit (CPU), various types of memory [for example, Random Access Memory (RAM), Read Only Memory (ROM), and non-volatile memory], and an input-output interface (I/O) is connected through a bus. Furthermore, to the I/O, for example, each portion of the extruder 210 such as the drive motor 230 for rotationally driving the screw 228, a drive motor for rotationally driving the drive roll 254 (not shown), or a pressure gauge 233 is connected.

For example, the CPU executes a program stored in the various types of memory (for example, a control program such as an extrusion-molding program), and controls the operation of each portion of the extruder 210. Moreover, the storage medium for storing a program to be executed by the CPU is not limited to various types of memory. For example, the storage medium may be a flexible disk, a DVD disk, a magneto-optical disk, a universal serial bus memory (USB memory), or the like (not shown), or may be a storage device of another device connected to the communication unit (not shown).

Second Step

In the second step, the oxygen-curable compound is deposited on the surface of the layer of the rubber material (rubber composition). Specifically, for example, the rubber roll obtained by forming a rubber material layer including the unvulcanized rubber material and the oxygen-curable compound on the outer peripheral surface of the core metal (support) is stored in an environment at a temperature lower than the vulcanizing temperature of the unvulcanized rubber material and the curing temperature of the oxygen-curable compound. Thus, the oxygen-curable compound (in the case of using a curing accelerator, the oxygen-curable compound and the curing accelerator) is deposited on the surface of the layer of the rubber material, whereby a deposition layer is formed. In storage of the rubber roll, for example, a heating furnace (hot air heating furnace or the like) is used.

Here, the storage conditions may be the following conditions from the viewpoint of ensuring the thickness of the deposition layer which becomes the surface layer by sufficiently depositing the oxygen-curable compound.

The temperature of the storage environment may be, for example, from 50° C. to 140° C. (preferably, from 70° C. to 120° C.). The humidity of the storage environment may be, for example, from 20% RH to 50% RH (preferably, from 20% RH to 40% RH). The storage time may be, for example, from 0.1 hours to 2 hours (preferably, from 0.2 hours to 1.0 hour).

Third Step

In the third step, in a state in which the oxygen-curable compound is deposited on the surface of the layer of the rubber material (rubber composition), vulcanizing of the unvulcanized rubber material and curing of the oxygen-curable compound are performed. Thus, an elastic layer including a vulcanizate of the unvulcanized rubber material is formed on the core metal (support), and a surface layer including a cured product of the oxygen-curable compound is formed on the elastic layer.

Specifically, the layer of the rubber material including the unvulcanized rubber material and the deposition layer obtained by depositing the oxygen-curable compound are heated to the vulcanizing temperature of the unvulcanized rubber material and the curing temperature of the oxygen-curable compound in an environment including oxygen. The heating of the layer of the rubber material and the deposition layer is performed, for example, by a heating furnace (hot air heating furnace or the like).

Specifically, for example, the rubber roll in which the layer of the rubber material and the deposition layer are formed on the outer peripheral surface of the core metal (support) in this order is heated under the conditions of normal pressure (for example, 1 atm), an oxygen concentration from 200,000 ppm (by weight) to 990,000 ppm (by weight), a heating temperature from 150° C. to 200° C., and a heating time from 10 minutes to 120 minutes. Thus, vulcanizing of the unvulcanized rubber material included in the layer of the rubber material and curing of the oxygen-curable compound included in the deposition layer are performed together, whereby an elastic layer and a surface layer are formed.

Moreover, the oxygen concentration in the heating environment may be the same as the oxygen concentration in the atmosphere, or may be higher than the oxygen concentration in the atmosphere.

Through the above steps, the conductive member according to the exemplary embodiment is formed.

In the preparation method of the conductive member according to the exemplary embodiment, by being deposited on the surface of the layer of the rubber composition, the oxygen-curable compound is likely to form a deposition layer in a state in which the thickness is nearly uniform. When curing the oxygen-curable compound of the deposition layer, a surface layer of which the thickness is nearly uniform and the surface quality is high is likely to be formed. Therefore, a nearly uniform contact width (nip width) between the surface layer of the conductive member and a member to be charged is likely to be ensured. Accordingly, when forming an elastic layer and a surface layer through at least the above steps, charge unevenness is likely to be prevented. In addition, separately, a coating step for forming a surface layer may be omitted, and cost reduction may also be achieved.

Moreover, the preparation method of the conductive member according to the exemplary embodiment is not limited to the preparation method described above. For example, in the preparation method of the conductive member according to the exemplary embodiment, after forming a conductive elastic layer including a vulcanizate of the unvulcanized rubber material (that is, after vulcanizing the unvulcanized rubber material), a surface layer including a cured product of the oxygen-curable unsaturated compound may be formed.

Charging Device

Next, the charging device according the exemplary embodiment will be described.

Figure 4:
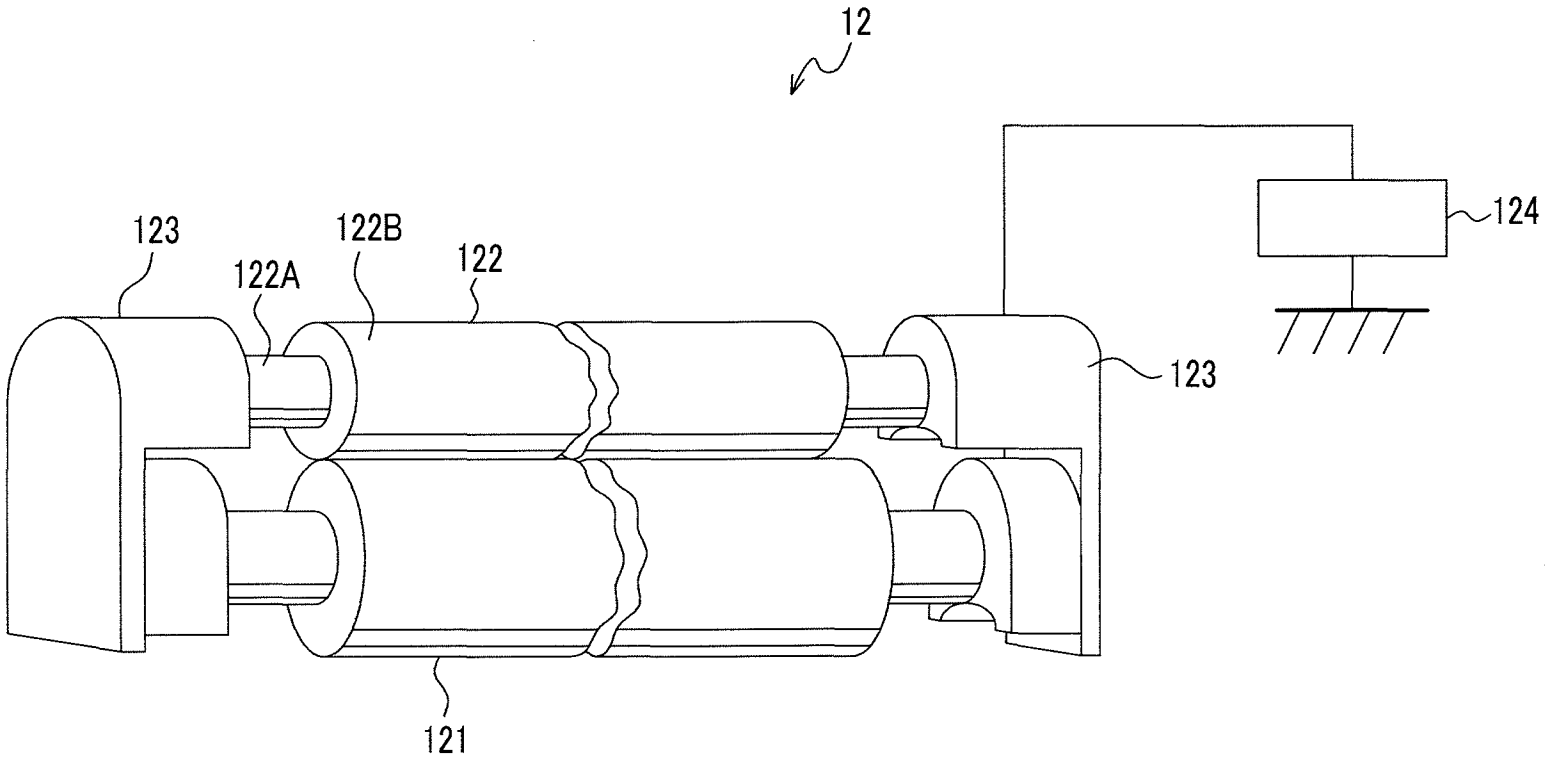
FIG. 4 is a schematic diagram showing an example of a configuration of a charging device according to the exemplary embodiment.

FIG. 4 is a schematic diagram showing an example of the charging device according to the exemplary embodiment.

The conductive member according to the exemplary embodiment described above is applied to the charging device according to the exemplary embodiment as a charging member.

Specifically, as shown in FIG. 4, in a charging device 12 according to the exemplary embodiment, for example, the charging member 121 and a cleaning member 122 are provided in contact with a specific amount of engagement. Furthermore, both ends in the axial direction of the conductive support 30 of the charging member 121 and a conductive support 122A of the cleaning member 122 are held by conductive bearings 123 such that each member becomes freely rotatable. A power supply 124 is connected to one of the conductive bearings 123.

Moreover, the charging device according to the exemplary embodiment is not limited to the above-described configuration, and for example, the charging device according to the exemplary embodiment may not be provided with the cleaning member 122.

The cleaning member 122 is a cleaning member for cleaning the surface of the charging member 121, and for example, the cleaning member 122 is configured in a roll shape. The cleaning member 122 is, for example, configured of the cylindrical or columnar conductive support 122A and an elastic layer 122B on the outer peripheral surface of the conductive support 122A.

The conductive support 122A is a rod shape conductive member, and examples of the material thereof include metals such as iron (free-cutting steel or the like), copper, brass, stainless steel, aluminum, and nickel. In addition, as the conductive support 122A, a member (for example, a resin member and a ceramic member) subjected to a plating treatment on the outer peripheral surface, a member (for example, a resin member and a ceramic member) in which a conductive material is dispersed, and the like may also be exemplified. The conductive support 122A may be a hollow shape member (cylindrical member), or may be a non-hollow shape member.

The elastic layer 122B is formed of a foamed member having a porous three-dimensional structure, and has cavities or uneven portions (hereinafter, referred to as "cell") therein or on the surface, and may have elasticity. The elastic layer 122B is configured to include an expandable resin material or a rubber material such as polyurethane, polyethylene, polyamide, olefin, melamine, polypropylene, NBR (acrylonitrile-butadiene copolymer rubber), EPDM (ethylene-propylene-diene copolymer rubber), natural rubber, styrene-butadiene rubber, chloroprene, silicone, or nitrile.

Among these expandable resin materials or a rubber materials, in order to efficiently clean a foreign matter such as a toner or an external additive by driven frictional sliding with the charging member 121, to prevent scratches on the surface of the charging member 121 due to rubbing with the cleaning member 122, and to prevent breakage or damage over a long period of time, polyurethane which is resistant to tear or tensile strength is particularly suitably applied.

The polyurethane is not particularly limited, and examples thereof include reaction products of polyols (for example, polyester polyol, polyether polyol, and acrylic polyol) with isocyanates (2,4-tolylene diisocyanate, 2,6-tolylene diisocyanate, 4,4-diphenylmethane diisocyanate, tolidine diisocyanate, and 1,6-hexamethylene diisocyanate), and the polyurethane may be reaction products by chain extenders (for example, 1,4-butanediol, and trimethylol propane) thereof. Moreover, in general, the polyurethane is foamed by using a foaming agent (water or azo compound (azodicarbonamide or azobisisobutyronitrile)).

The number of cells of the elastic layer 122B is preferably from 20/25 mm to 80/25 mm, more preferably from 30/25 mm to 80/25 mm, and particularly preferably from 30/25 mm to 50/25 mm.

The hardness of the elastic layer 122B is preferably from 100 N to 500 N, more preferably from 100 N to 400 N, and particularly preferably from 150 N to 400 N.

The conductive bearings 123 are a member which rotatably holds the charging member 121 and the cleaning member 122 in one piece, and keeps the shaft-to-shaft distance between the members. The conductive bearings 123 may be formed of any material and in any form as long as it is manufactured from a material having conductivity, and for example, a conductive bearing, a conductive sliding bearing, or the like is applied.

The power supply 124 is a device which charges the charging member 121 and the cleaning member 122 to the same polarity by applying a voltage to the conductive bearings 123, and a known high voltage power supply device is used as the power supply 124.

In the charging device 12 according to the exemplary embodiment, for example, the charging member 121 and the cleaning member 122 are charged to the same polarity by applying a voltage to the conductive bearings 123 from the power supply 124.

Image Forming Apparatus

Next, the image forming apparatus according to the exemplary embodiment will be described.

The image forming apparatus according to the exemplary embodiment is configured to include an electrophotographic photoreceptor, a charging unit having the charging member according to the exemplary embodiment described above, which charges the electrophotographic photoreceptor by bringing the charging member into contact with the surface of the electrophotographic photoreceptor, an electrostatic latent image forming unit for forming an electrostatic latent image on the surface of the charged electrophotographic photoreceptor, a developing unit for developing the electrostatic latent image formed on the surface of the electrophotographic photoreceptor with a developer including a toner to form a toner image, and a transferring unit for transferring the toner image to the surface of a recording medium.

Figure 5:
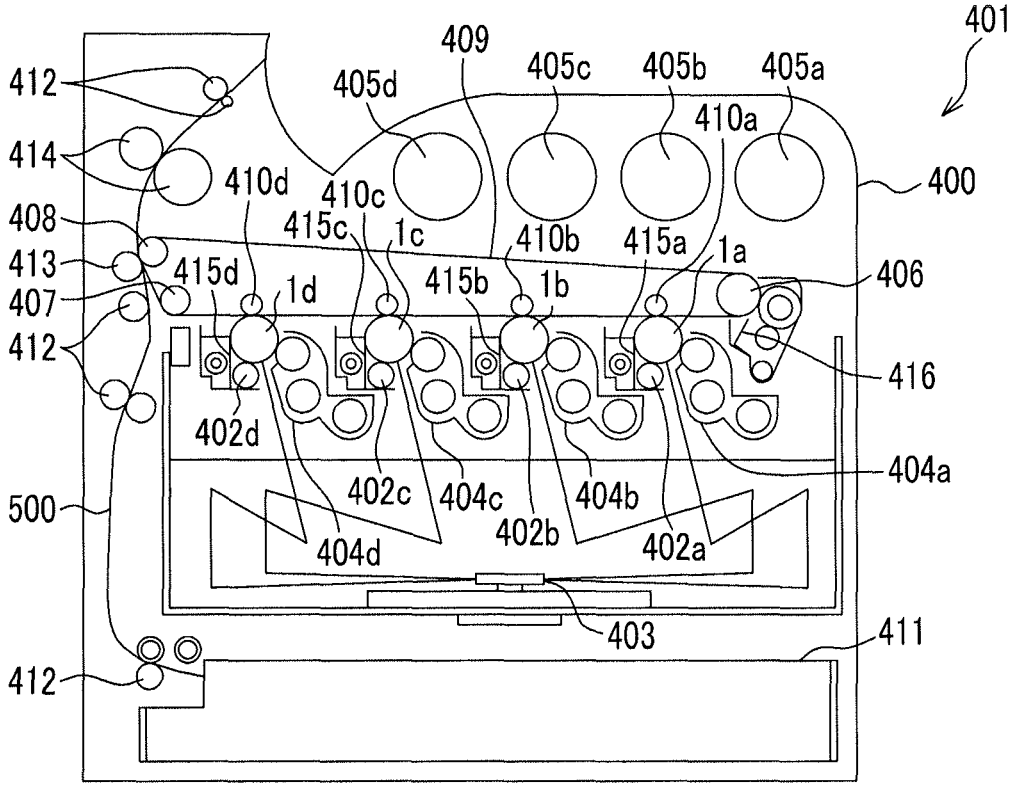
FIG. 5 is a schematic diagram showing an example of a configuration of an image forming apparatus according to the exemplary embodiment.

FIG. 5 schematically shows an example of a basic configuration of the image forming apparatus according to the exemplary embodiment. The image forming apparatus 401 shown in FIG. 5 is an intermediate transfer-type image forming apparatus, and four electrophotographic photoreceptors 1*a*, 1*b*, 1*c*, and 1*d* are provided in parallel with each other along an intermediate transfer belt 409 in a housing 400. For example, the photoreceptor 1*a* forms a yellow-colored image, the photoreceptor 1*b* forms a magenta-colored image, the photoreceptor 1*c* forms a cyan-colored image, and the photoreceptor 1*d* forms a black-colored image, respectively.

Here, each of the electrophotographic photoreceptors 1*a*, 1*b*, 1*c*, and 1*d* mounted on the image forming apparatus 401 is an electrophotographic photoreceptor of the exemplary embodiment.

Each of the electrographic photoreceptors 1*a*, 1*b*, 1*c*, and 1*d* rotates in one direction (counterclockwise rotation on the paper), and charging rolls 402*a*, 402*b*, 402*c*, and 402*d*, developing devices 404*a*, 404*b*, 404*c*, and 404*d*, primary transfer rolls 410*a*, 410*b*, 410*c*, and 410*d*, and cleaning blades 415*a*, 415*b*, 415*c*, and 415*d* are provided along the rotation direction thereof. Each of the charging rolls 402*a*, 402*b*, 402*c*, and 402*d* is a charging roll according to the exemplary embodiment described above, and a contact charging system is employed therefor.

The developing devices 404*a*, 404*b*, 404*c*, and 404*d* respectively supply four color toners, that is, a yellow toner, a magenta toner, a cyan toner, and a black toner accommodated in toner cartridges 405*a*, 405*b*, 405*c*, and 405*d*, and the primary transfer rolls 410*a*, 410*b*, 410*c*, and 410*d* are respectively in contact with the electrophotographic photoreceptors 1*a*, 1*b*, 1*c*, and 1*d* through the intermediate transfer belt 409.

A laser beam source (exposing device) 403 is provided in the housing 400, and the surfaces of the electrophotographic photoreceptors 1*a*, 1*b*, 1*c*, and 1*d* after charging are irradiated with the laser beam which is emitted from the laser beam source 403.

Thus, in the rotation step of the electrophotographic photoreceptors 1*a*, 1*b*, 1*c*, and 1*d*, each step of charging, exposing, developing, primary transfer, and cleaning (removal of foreign matter such as a toner) is sequentially performed, and toner images of each color are transferred on the intermediate transfer belt 409 in a superimposed manner. Furthermore, the electrophotographic photoreceptors 1*a*, 1*b*, 1*c*, and 1*d* after the toner images are transferred on the intermediate transfer belt 409 are subjected to the next image forming process without going through the step of removing the charge on the surface.

The intermediate transfer belt 409 is supported with tension by a drive roll 406, a backup roll 408, and a support roll 407, and is rotated without generating deflection by the rotation of these rolls. In addition, a secondary transfer roll 413 is provided to contact with the backup roll 408 through the intermediate transfer belt 409. The intermediate transfer belt 409 which passes through the position between the backup roll 408 and the secondary transfer roll 413 is surface-cleaned by, for example, a cleaning blade 416 provided to oppose the drive roll 406, and then the intermediate transfer belt is repeatedly provided for the next image forming process.

In addition, a tray 411 for containing a recording medium is provided in the housing 400, and a recording medium 500 such as a sheet in the tray 411 is sequentially fed to the position between the intermediate transfer belt 409 and the secondary transfer roll 413 by a feeding roll 412, and also the position between two fixing rolls 414 which contact with each other, and then is discharged to the outside of the housing 400.

Although the case of using the intermediate transfer belt 409 as an intermediate transfer medium is described in the above description, the intermediate transfer member may be a belt shape as the intermediate transfer belt 409, or may be a drum shape. In the case of a belt shape, as the resin material configuring the substrate material of the intermediate transfer member, a known resin is used. Examples of the resin material include a polyimide resin, a polycarbonate resin (PC), polyvinylidene fluoride (PVDF), polyalkylene terephthalate (PAT), and blended materials such as ethylene tetrafluoroethylene copolymer (ETFE)/PC, ETFE/PAT, and PC/PAT, resin materials such as polyester, polyether ether ketone, and polyamide, and resin materials formed by using these as a main raw material. Furthermore, the resin material and an elastic material may be used by mixing.

In addition, the recording medium according to the exemplary embodiment described above is not particularly limited as long as it is a medium to which the toner image formed on the electrophotographic photoreceptors is transferred.

Process Cartridge

The process cartridge of the exemplary embodiment includes a charging unit having the charging member according to the exemplary embodiment as described above, which charges the electrophotographic photoreceptor by bringing the charging member into contact with the surface of the electrophotographic photoreceptor, and the process cartridge is configured to be detachable from the image forming apparatus.

Figure 6:
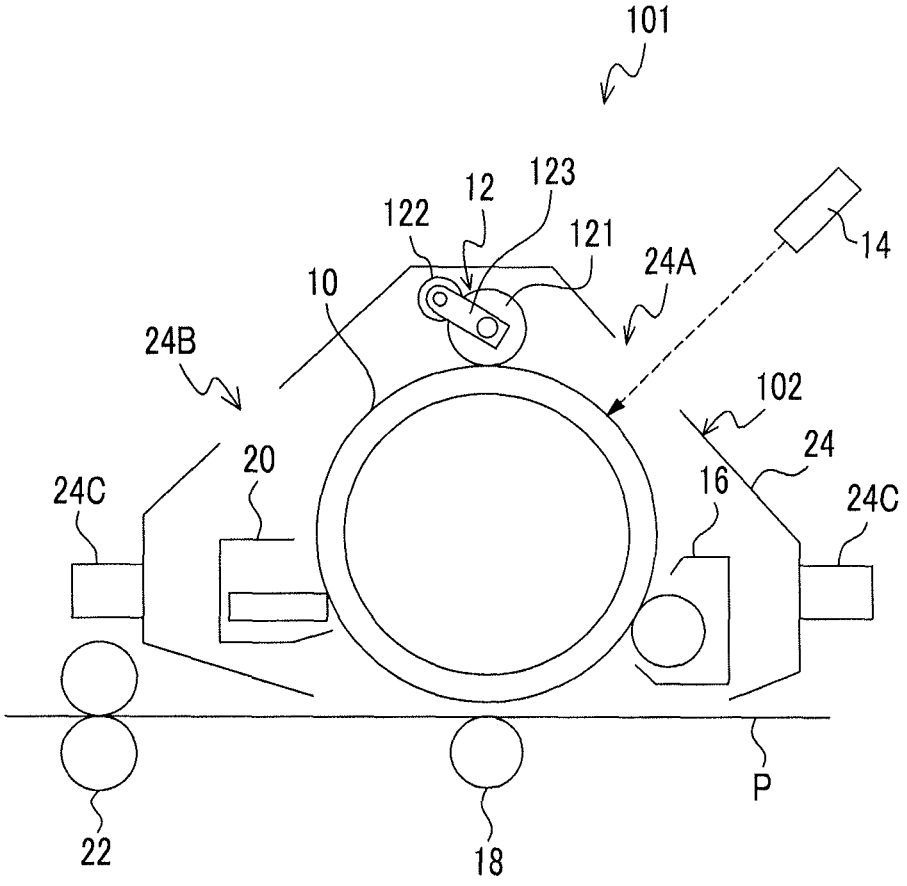
FIG. 6 is schematic diagram showing an example of a configuration of a process cartridge according to the exemplary embodiment.

FIG. 6 schematically shows a basic configuration of an example of the process cartridge according to the exemplary embodiment. As shown in FIG. 6, the process cartridge according to the exemplary embodiment is a process cartridge 102 configured by integrally combining and holding the charging device 12 having the electrophotographic photoreceptor 10 and the conductive member according to the exemplary embodiment described above as a charging member 121, which charges the electrophotographic photoreceptor 10 by bringing the charging member 121 into contact with the surface of the electrophotographic photoreceptor 10, a developing device 16 for developing a latent image formed by an exposing device 14 by the toner to form a toner image, and a cleaning device 20 for removing the residual toner on the surface of the electrophotographic photoreceptor 10 after transferring, by a housing 24 provided with an opening portion 24A for exposure, an opening portion 24B for erasing exposure, and a mounting rail 24C. Furthermore, the process cartridge 102 is mounted so as to be freely attached to and detached from the image forming apparatus 101. In addition, the image forming apparatus 101 according to the exemplary embodiment is configured to have a fixing device 22 for fixing a toner image transferred to a recording medium P by a transfer device 18.

EXAMPLES

Hereinafter, the present invention will be described in more detail based on Examples, but, the present invention is not limited to the following Examples. Moreover, unless otherwise specifically indicated, "part(s)" means "part(s) by weight".

Example 1

Preparation of Charging Roll

Preparation of Rubber Composition

For preparing a charging roll, a mixture having the following composition is kneaded using a tangential pressure kneader (manufactured by Moriyama: actual capacity of 55 L), and is passed through a strainer, whereby a rubber composition is prepared.

In detail, the jacket, the pressuring lid, the rotor of the pressure kneader is set to 20° C. by circulating water, then, the pressure of the pressuring lid is set to 0.6 MPa, and the following elastic material is masticated, and after kneading cobalt oxide, stearic acid and carbon black are put thereinto and kneaded, and an ion conductive material and calcium carbonate are put thereinto and kneaded. The resultant product is cut into a sheet shape using a biaxial sheet pre-forming machine (manufactured by Moriyama, actual capacity of 75 L), and after cooling to room temperature (25° C.), a crosslinking agent and a vulcanization accelerator are added thereto and kneaded using the pressure kneader again, and the resultant product is passed through the strainer three times using a gear pump extruder, whereby a rubber composition is obtained.

Composition of Rubber Composition

Unvulcanized rubber material . . . 100 parts by weight
(epichlorohydrin-ethylene oxide-allyl glycidyl ether copolymer rubber (GECO: unvulcanized rubber material having a polar group), trade name "Epichlomer CG-102", manufactured by DAISO)

Cobalt oxide . . . 5 parts by weight
(trade name "Cobalt Oxide Type II", manufactured by Seido Chemical Industry Co., Ltd.)

Tung oil . . . 5.0 parts by weight
(oxygen-curable compound, distributed by MIYOSHI OIL & FAT CO., LTD.)

Stearic acid . . . 1 part by weight
(trade name "Stearic Acid S", manufactured by Kao Corporation)

Carbon black . . . 15 parts by weight
(trade name "Ketjen Black EC", manufactured by Lion Corporation)

Calcium carbonate . . . 20 parts by weight
(trade name "Hakuenka CCR", manufactured by Shiraishi Kogyo 'Kaisha, Ltd.")

Ionic conductive material . . . 1 part by weight
(benzyltrimethylammonium chloride, trade name "BTMAC", manufactured by Lion Akzo Co., Ltd.)

Crosslinking agent . . . 1 part by weight
(trade name "Sulfur 200 mesh", manufactured by Tsurumi Chemical Industry Co., Ltd.)

Vulcanization accelerator . . . 2 parts by weight
(trade name "Nocceler DM", Ouchi Shinko Chemical Industrial Co., Ltd.)

Vulcanization accelerator . . . 0.5 parts by weight
(trade name "Nocceler TT", Ouchi Shinko Chemical Industrial Co., Ltd.)

Cobalt octylate (curing accelerator) . . . 2.0 parts by weight
(trade name "Co-OCTOATE 12%", manufactured by DIC Corporation)

Formation of Adhesive Layer

A mixture having the following composition is dispersed using a bead mill, whereby a dispersion is prepared. The dispersion is applied to a conductive support by a dipping coating method, and dried at 150° C. for 10 minutes, and the solvent is removed therefrom, whereby an adhesive layer is obtained.

Composition of Adhesive Layer

Resin material . . . 100 parts by weight
(chlorosulfonated polyethylene, trade name "CN1500", manufactured by Tosoh Corporation)

Conductive material . . . 40 parts by weight
(carbon black, trade name "Ketjen Black EC600JD", manufactured by Lion Corporation)

Solvent . . . 640 parts by weight
(xylene, manufactured by Kanto Chemical Co., Inc.)

Acid acceptor . . . 5.0 parts by weight
(magnesium oxide, trade name "Kyowamag 150", manufactured by Kyowa Chemical Industry Co., Ltd.)

Crosslinking agent . . . 1.5 parts by weight
(2,4,6-trimercapto-s-triazine, trade name "ZISNET F (TTCA)", manufactured by Sankyo Kasei Co., Ltd.)

Accelerator . . . 1.0 part by weight
(1,8-diazabicyclo(5.4.0)undecene-7, trade name "DBU", manufactured by San-Apro Ltd.)

Formation of Elastic Layer and Surface Layer

A support made of SUS303 having an adhesive layer, which has a diameter of 8 mm and a length of 330 mm is prepared, and by extruding the prepared rubber composition and by continuously passing the support through the crosshead at the same time at a screw rotation speed of 25 rpm using a uniaxial rubber extruder having a cylinder inner diameter of 60 mm and L/D of 20 (L represents a length (mm) of the screw and D represents a diameter (mm) of the screw), the support is coated with the layer of the rubber composition. In the temperature condition setting of the extruder, all of the cylinder portion, the screw portion, the head portion, and die portion are set to 80° C.

Next, an unvulcanized rubber roll in which the support is coated with the layer of the rubber composition is stored in a state of being heated at 100° C. for 30 minutes in an air heating furnace, and tung oil (oxygen-curable compound) and cobalt octylate (curing accelerator) are deposited on the surface of the layer of the rubber composition.

Thereafter, the rubber roll in which tung oil (oxygen-curable compound) and cobalt octylate (curing accelerator) are deposited on the surface of the layer of the rubber composition is heated at 170° C. for 70 minutes.

Through the above steps, a charging roll in which an elastic layer and a surface layer are sequentially formed on the support is obtained.

Example 2

An adhesive layer and a rubber composition are prepared in the same manner as in Example 1 except that the mixing amount of tung oil (oxygen-curable compound, distributed by MIYOSHI OIL & FAT CO., LTD.) is changed to 1.0 part by weight, and, using them, a charging roll is obtained.

Example 3

An adhesive layer and a rubber composition are prepared in the same manner as in Example 1 except that the mixing amount of tung oil (oxygen-curable compound, distributed by MIYOSHI OIL & FAT CO., LTD.) is changed to 15.0 parts by weight, and, using them, a charging roll is obtained.

Example 4

An adhesive layer and a rubber composition are prepared in the same manner as in Example 1 except that 5.0 parts by weight of liquid acrylonitrile-butadiene copolymer rubber (liquid NBR: unvulcanized liquid rubber material: trade name "N280", manufactured by JSR Corporation) is additionally added, and, using them, a charging roll is obtained.

Example 5

An adhesive layer and a rubber composition are prepared in the same manner as in Example 1 except that an alkyd resin (oxygen-curable compound: trade name "M-2168-50", alkyd resin obtained by phenol-modifying linseed oil and tung oil, manufactured by DIC Corporation) is used instead of the tung oil, and the mixing amount of an alkyd resin is 1.0 part by weight, and, using them, a charging roll is obtained.

Example 6

An adhesive layer and a rubber composition are prepared in the same manner as in Example 1 except that an alkyd resin (oxygen-curable compound: trade name "M-2168-50", alkyd resin obtained by phenol-modifying linseed oil and tung oil, manufactured by DIC Corporation) is used instead of the tung oil, and the mixing amount of alkyd resin is 15.0 parts by weight, and, using them, a charging roll is obtained.

Example 7

An adhesive layer and a rubber composition are prepared in the same manner as in Example 1 except that chloroprene rubber (CR: unvulcanized rubber material having a polar group, trade name "Skyprene B-5", manufactured by Tosoh Corporation) is used instead of the unvulcanized rubber material, and, using them, a charging roll is obtained.

Example 8

An adhesive layer and a rubber composition are prepared in the same manner as in Example 1 except that the unvulcanized rubber material is substituted with acrylonitrile-butadiene copolymer rubber (NBR: unvulcanized rubber material having a polar group: trade name "N230S", manufactured by JSR Corporation), and, using them, a charging roll is obtained.

Comparative Example 1

A rubber composition is prepared in the same manner as in Example 1 except that the tung oil (oxygen-curable compound, distributed by MIYOSHI OIL & FAT CO., LTD.) and cobalt octylate (curing accelerator: trade name "Co-OCTOATE 12%", manufactured by DIC Corporation) in Example 1 are not mixed in, and, using them, a vulcanized rubber roll in which an elastic layer is formed is obtained.

Next, a surface layer is formed by applying a coating liquid for forming a surface layer prepared by the following formulation to the elastic layer of the vulcanized rubber roll by a dipping coating method.

Formation of Surface Layer

A mixture having the following composition (composition of a coating liquid for forming a surface layer) is dispersed using a bead mill, whereby a dispersion is prepared. The obtained dispersion is diluted with methanol, whereby a coating liquid for forming a surface layer is obtained. The coating liquid for forming a surface layer is adjusted with methanol or butanol to have the viscosity of 45 mPa·s, and poured into a dipping coating tank.

Thereafter, the vulcanized rubber roll is dipped into the coating liquid for forming a surface layer in the dipping coating tank, and the vulcanized rubber roll is pulled up. This is dried at 150° C. for 10 minutes, and the solvent is removed, whereby a surface layer is formed. Thus, a charging roll having the adhesive layer, the elastic layer, and surface layer on the support in this order is obtained.

Composition of Coating Liquid for Forming Surface Layer

Polymer material . . . 100 parts by weight
(amide resin, trade name "Amilan CM8000" manufactured by Toray Industries, Inc.)

Conductive material . . . 14 parts by weight
(carbon black, trade name "Monarch 1000", manufactured by Cabot Corporation)

Solvent . . . 500 parts by weight
(methanol, manufactured by Kanto Chemical Co., Inc.)

Solvent . . . 240 parts by weight
(butanol, manufactured by Kanto Chemical Co., Inc.)

Comparative Example 2

A rubber composition is prepared in the same manner as in Example 1 except that the tung oil (oxygen-curable compound, distributed by MIYOSHI OIL & FAT CO., LTD.) and cobalt octylate (curing accelerator: trade name "Co-OCTOATE 12%", manufactured by DIC Corporation) in Example 1 are substituted with a curable acrylic monomer (trimethylolpropane triacrylate: trade name "NK Ester A-TMPT", manufactured by Shin-Nakamura Chemical Co., Ltd.), and, using this, an unvulcanized rubber roll in which the support is coated with a layer of the rubber composition is obtained using a crosshead extruder. Thereafter, a heat treatment is performed on the unvulcanized rubber roll at 120° C. for 30 minutes and at 160° C. for 30 minutes. Thus, a vulcanized rubber roll in which an elastic layer is formed on the support and a curable acrylic monomer is deposited on the elastic layer is obtained.

Next, the deposited curable acrylic monomer is cured by irradiating the vulcanized rubber roll surface with an electron beam, whereby a surface layer is formed.

Thus, a charging roll having the adhesive layer, the elastic layer, and surface layer on the support in this order is obtained.

Example 9

An adhesive layer and a rubber composition are prepared in the same manner as in Example 1 except that the mixing amount of tung oil (oxygen-curable compound, distributed by MIYOSHI OIL & FAT CO., LTD.) is changed to 0.5 parts by weight, and, using them, a charging roll is obtained.

Example 10

An adhesive layer and a rubber composition are prepared in the same manner as in Example 1 except that the mixing amount of tung oil (oxygen-curable compound, distributed by MIYOSHI OIL & FAT CO., LTD.) is changed to 20.0 parts by weight, and, using them, a charging roll is obtained.

Experimental Evaluation

The charging rolls of Examples and Comparative Examples are mounted on the image forming apparatus "color copying machine DocuCentre Color 400CP: manufactured by Fuji Xerox Co., Ltd." shown in FIG. 5, and using color toners (cyan toner, magenta toner, yellow toner, and black toner) for the color copying machine DocuCentre Color 400CP, a test of printing 50,000 sheets of A4 paper (printing 25,000 sheets in an environment of 28° C. and 85% RH after printing 25,000 sheets in an environment of 10° C. and 15% RH) is performed. Moreover, in a case where a serious problem occurs during printing, printing is stopped at that time.

In the image quality evaluation, the initial image and the image after traveling 50,000 sheets are visually observed, and the images are evaluated by the presence or absence of the density unevenness in the halftone image according to the following criteria. Moreover, the initial density unevenness is described as the density unevenness due to the total deviation in Table 1, and the density unevenness after traveling 50,000 sheets is described as the density unevenness over time due to filming in Table 1.

Evaluation Criteria

A: Defect such as density unevenness is not observed.

B: Extremely slight density unevenness occurs.

C: Slight density unevenness occurs.

D: Significant density unevenness occurs.

E: Density unevenness with which an image is actually unusable occurs.

Peeling of Surface Layer

For the charging rolls of Examples and Comparative Examples, peeling of the surface layer is evaluated in the following manner. The testing method is based on JIS K 5600-5-6 Cross-Cut Adhesion Test. In detail, after the surface layer is cut into 25 squares of length 5 squares×width 5 squares when 1 square has a size of 2 mm×2 mm, an adhesive tape is attached thereto, then the resultant product is pressurized with a roller of 1 kg, and the number of squares remaining without being peeled when the tape is peeled off from the end is evaluated. Moreover, the evaluation criteria are as follows.

Evaluation Criteria

A: Any one of 25 squares is not peeled.

B: From 1 square to 9 squares are peeled.

C: From 10 squares to 19 squares are peeled.

D: From 20 squares to 24 squares are peeled.

E: All of 25 squares are peeled.

Details of Examples and Comparative Examples, and the evaluation results are shown in Table 1.

TABLE 1

| | Elastic layer | | Surface layer | | | | Experimental evaluation | | |
|---|---|---|---|---|---|---|---|---|---|
| | Unvulcanized rubber material (presence or absence of polar group) | Liquid rubber material | Oxygen-curable compound Type | Number of parts in rubber composition | Iodine value (g/100 g) | Thickness (μm) | Initial stage | After traveling 50,000 sheets | Evaluation of peeling of surface layer |
| Example 1 | GEGO (present) | Absent | Tung oil | 5.0 | 162.4 | 4.2 | A | A | A |
| Example 2 | GECO (present) | Absent | Tung oil | 1.0 | 162.4 | 2.1 | A | B | A |
| Example 3 | GEGO (present) | Absent | Tung oil | 15.0 | 162.4 | 8.2 | A | B | A |
| Example 4 | GECO (present) | Liquid NBR | Tung oil | 5.0 | 162.4 | 4.5 | A | A | A |
| Example 5 | GECO (present) | Absent | Alkyd resin | 1.0 | 160.3 | 2.2 | A | A | A |
| Example 6 | GECO (present) | Absent | Alkyd resin | 15.0 | 160.3 | 8.1 | A | A | A |
| Example 7 | CR (present) | Absent | Tung oil | 5.0 | 162.4 | 4.5 | A | A | A |
| Example 8 | NBR (present) | Absent | Tung oil | 5.0 | 162.4 | 4.1 | A | A | A |
| Comparative Example 1 | GECO (Present) | Absent | Absent (amide resin) | — | — | 2.1 | C | C | D |
| Comparative Example 2 | GECO (present) | Absent | Absent (amide resin) | — | — | 0.2 | D | D | D |
| Example 9 | GECO (present) | Absent | Tung oil | 0.5 | 162.4 | 0.2 | B | B | B |
| Example 10 | GECO (present) | Absent | Tung oil | 20.0 | 162.4 | 14.3 | B | B | A |

From the results described above, it is found that, in Examples, excellent results are obtained from the evaluation of peeling of the surface layer, compared to Comparative Examples.

In addition, it is found that, in Examples, excellent results are also obtained from the experimental evaluation (evaluation of density unevenness), compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive member comprising:

a conductive support;

a conductive elastic layer that is provided on the conductive support and includes a vulcanizate of an unvulcanized rubber material; and a surface layer that is provided on the conductive elastic layer and includes a cured product of an oxygen-curable unsaturated compound, wherein the conductive elastic layer and the surface layer are formed through at least forming a layer of a rubber composition including the unvulcanized rubber material and the oxygen-curable unsaturated compound on the conductive support, depositing the oxygen-curable unsaturated compound on the surface of the layer of the rubber composition, and performing vulcanizing of the unvulcanized rubber material and curing of the oxygen-curable unsaturated compound in a state in which the oxygen-curable unsaturated compound is deposited on the surface of the layer of the rubber composition.

2. The conductive member according to claim 1, wherein the oxygen-curable unsaturated compound has a carbon-carbon double bond.

3. The conductive member according to claim 1, wherein the oxygen-curable unsaturated compound is at least one selected from the group consisting of an unsaturated fatty acid, an alkyd resin obtained by modifying an unsaturated fatty acid, a reaction product between drying oil and functional polyoxyalkylene, a reaction product between an unsaturated fatty acid and an isocyanate compound, and a resin modified by an unsaturated fatty acid.

4. The conductive member according to claim 1, wherein the unsaturated compound is drying oil.

5. The conductive member according to claim 1, wherein the unsaturated compound is at least one selected from the group consisting of tung oil, linseed oil, cotton seed oil, soybean oil, drying oil, rice bran oil, dehydrated castor oil, and tall oil.

6. The conductive member according to claim 1, wherein the iodine value of the oxygen-curable unsaturated compound is from 130 g/100 g to 220 g/100 g.

7. The conductive member according to claim 1, wherein the unvulcanized rubber material includes an unvulcanized rubber material having a polar group.

8. The conductive member according to claim 1, wherein the unvulcanized rubber material includes an unvulcanized liquid rubber material.

9. The conductive member according to claim 8, wherein the unvulcanized liquid rubber material is liquid acrylonitrile-butadiene copolymer rubber.

10. A process cartridge which is detachable from an image forming apparatus, the process cartridge comprising:

a charging unit that includes the conductive member according to claim 1 as a charging member, and charges an electrophotographic photoreceptor by bringing the charging member into contact with a surface of the electrophotographic photoreceptor.

11. An image forming apparatus, comprising:

an electrophotographic photoreceptor;

a charging unit that includes the conductive member according to claim 1 as a charging member, and charges the electrophotographic photoreceptor by bringing the charging member into contact with a surface of the electrophotographic photoreceptor;

an electrostatic latent image forming unit that forms an electrostatic latent image on a surface of the charged electrophotographic photoreceptor;

a developing unit that develops the electrostatic latent image formed on the surface of the electrophotographic photoreceptor with a developer including a toner to form a toner image; and a transferring unit that transfers the toner image to a surface of a recording medium.

* * * * *